US006747000B2

(12) United States Patent
Pearce et al.

(10) Patent No.: US 6,747,000 B2
(45) Date of Patent: Jun. 8, 2004

(54) PROCESS FOR MAKING SOLID CLEANING COMPONENTS

(75) Inventors: Emma Jane Pearce, Newcastle-Upon-Tyne (GB); David Banks, Newcastle-Upon-Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/849,552

(22) Filed: May 4, 2001

(65) Prior Publication Data

US 2002/0032145 A1 Mar. 14, 2002

(30) Foreign Application Priority Data

May 5, 2000 (GB) ..... 0010851

(51) Int. Cl.[7] ..... C11D 11/00

(52) U.S. Cl. ..... 510/446; 510/451; 510/441; 510/442

(58) Field of Search ..... 510/441, 442, 510/444, 451, 446

(56) References Cited

U.S. PATENT DOCUMENTS

| | | | | |
|---|---|---|---|---|
| 3,936,537 A | * | 2/1976 | Baskerville, Jr. et al. | 427/242 |
| 4,713,079 A | * | 12/1987 | Chun et al. | 8/101 |
| 4,834,902 A | * | 5/1989 | Pioch et al. | 510/232 |
| 4,997,590 A | * | 3/1991 | Bowling | 252/186.31 |
| 5,286,470 A | * | 2/1994 | Delwel | 423/332 |
| 5,520,860 A | * | 5/1996 | Tapper et al. | 264/15 |
| 5,955,418 A | | 9/1999 | Kazuta et al. | 510/451 |
| 5,968,891 A | * | 10/1999 | Mallari et al. | 510/444 |

FOREIGN PATENT DOCUMENTS

| | | | |
|---|---|---|---|
| EP | 0220024 A2 | * | 4/1987 |
| WO | WO 97/21487 A1 | | 6/1997 |
| WO | WO 99/32599 A1 | | 7/1999 |
| WO | WO 00/27961 A1 | | 5/2000 |
| WO | WO 00/27980 A1 | | 5/2000 |

* cited by examiner

*Primary Examiner*—Lorna M. Douyon
(74) *Attorney, Agent, or Firm*—Marianne Dressman; Brian M. Bolam; Brahm J. Corstanje

(57) ABSTRACT

A process for making beads of dry material for detergents, resulting in more robust beads, by contacting the beads with water to introduce very small levels of moisture to the beads. Colored beads, detergent formulations containing these beads and, in particular, softening through the wash compositions containing clay and the beads are disclosed.

9 Claims, No Drawings

PROCESS FOR MAKING SOLID CLEANING COMPONENTS

CROSS REFERENCE TO RELATED APPLICATIONS

This application claims priority under 35 U.S.C. § 119(a) to Great Britain Application No. 0010851.4, filed May 5, 2000.

TECHNICAL FIELD

The invention relates to process for making improved beads for cleaning compositions, comprising solid materials, including surfactant, and purposely added specific amount of water and to thus obtained beads and to compositions containing these beads.

BACKGROUND TO THE INVENTION

To introduce surfactants into solid cleaning compositions, detergent manufacturers mainly use granulation processes whereby liquid surfactants or pastes of surfactant in water are mixed with powders, to form granules, or whereby liquid surfactants or solutions thereof are sprayed onto solid granules.

For example, to make surfactant-containing granules, surfactant flakes or needles are typically made into surfactant pastes, by dissolving or dispersing the needles into water and optionally adding additional ingredients to this paste. The paste then formed into granules. Standard processes to make detergent granules with surfactants are agglomeration, extrusion and spray-drying. The resulting granules need to be dried because otherwise the granules are very sticky and difficult to handle.

Also, if higher active granules are required, i.e. containing higher levels of surfactants, it is important to make the granules obtained as described above as dry as possible, to reduce stickiness.

The inventors found that these granules made form pastes and subsequently dried can be very brittle, resulting in dust formation during handling. This is in particular the case with high active surfactant particles.

The inventors found an improved process resulting in detergent granules or beads which are much less brittle. They found that by dry mixing and compacting dry granular ingredients, thereby forming larger dry granules or beads, and subsequently spraying on very small amounts of water, to slightly increase the free moisture level of these granules, the robustness of the resulting granules or beads is improved. The resulting granules or beads are non-sticky and less likely to form dust during handling. It is believed that only the surface of the compacted granules is modified, making the beads more robust.

Furthermore, the inventors found that even when brittle surfactant needles are used as one of the starting granular ingredient, the use of this process results in (high active) robust, non-sticky beads.

The thus obtained beads can be conveniently dry-added to other cleaning ingredients or stored prior to addition to the remaining cleaning composition particles.

Moreover, the inventors found that to reduce process complexity, the making of these beads can conveniently be combined with the making of speckle particles for the compositions, by spraying-on an aqueous solution of a specific dye onto the compacted dry granules. Thus, a convenient way of introducing high active surfactants particle and dye is obtained.

Moreover, the inventors found that it is beneficial to use the process of the invention to introduce speckles to the formulations, because the process requires relative small amounts of dye, because it is only applied on the surface of the beads. This reduces the need for large amount of dye in the product, which is beneficial because dye is known to have a tendency to 'bleed' out of the product, which is undesirable.

They also found that in particular cylinder shaped beads are beneficial to give a product speckle-appearance, without using too much dye in the products.

The inventors have also found that the coloured beads are particular useful in clay-containing products, such as softening through the wash products, to efficiently mask the colour of the clay in the product.

SUMMARY OF THE INVENTION

The invention relates to a process for making beads for cleaning compositions comprising the steps of a) compacting two or more dry granular components containing less than 4.5% by weight of free-moisture, and optionally a binder component, to form granules containing less than 4.5% by weight of free moisture; and b) contacting said granules with an amount of water sufficient to obtain beads with a free-moisture level to 5.5% to 15%.

Preferably, step b) is done by spraying the water onto the granules; preferably step a) is done by mixing the dry granular components, and optionally a binder component, to form a dry mixture and extruding this mixture, typically to obtain an extrudate which is subsequently reduced in size to form the beads of the required size.

Preferably, each of the dry granular components comprises less than 3.5% by weight of free moisture, or even less than 2.5% by weight.

Preferably, the resulting bead comprises from 6% to 10%, or even 6.5% to 8% by weight of free moisture.

The invention also relates to beads obtained by such processes, coloured beads, and cleaning compositions comprising such beads, in particular cleaning compositions comprising clay, such as fabric softening clays.

DETAILED DESCRIPTION

Process

The process of the invention involves compacting two or more granular components, to form a larger granule. Any compacting process can be used, but preferred is a process involving moulding and compacting, roller compacting and most preferably extrusion of the dry granular components. Such processes are known in the art.

In a preferred compacting process, the dry granular components, having been mixed together, are forced between two compaction rolls that applies a pressure to said mixture so that the rotation of the rolls transforms the mixture into a compacted sheet/flake.

Typically, the compacting step is followed by a size reduction step, for example cutting the long extrudates into granules of the required particle length, or for example, the compacted sheet/flake is granulated. One way to carry this out is to mill the compacted flake/sheet or to granulate the agglomerate mixture by conventional means. Milling may typically be carried out with a Flake Crusher FC 200® commercially available from Hosokawa Bepex GmbH.

Depending on the end particle size desired for granules to be formed into the beads herein, the milled material may further be sieved, for example carried out with a commercially available Alpine Airjet Screen.

Preferred is an extrusion process whereby the inlet and out let temperature of the extruder is less than 80° C., preferably less than 60° C. or even less than 45° C., and whereby the temperature in the extruder is increased, preferably up to 120° C., more preferably up to 80° C. or even up to 60° C.

Non-aqueous binders may be present in the process and in the beads. One or more of the dry mixed solid components may also act as binder, but when the term binder is used herein, it is meant that this is an optional additional ingredient, which is a liquid, typically viscous material during the compacting step. Preferred maybe alkoxylated alcohols, having an ethoxylation degree of 20 or more, more preferably of 60 or even 80 or more, preferred being TAE80, or polyethylene glycols.

It may even be possible to add very small amounts of water, up to 4% or even up to 2% by weight of the total of the component, but preferably no water is added during the compaction step.

The components to be incorporated in the beads are dry, which means herein that each of these components comprises no more than 4.5% of free moisture, preferably no more than 4% or even no more than 3.5% or even no more than 2.5% by weight of the component. It may even be preferred that there is substantially no free moisture present in the dry components.

The free moisture level can be determined by placing 5 grams of the granular component or the bead herein in a petri dish and placing this petri dish in a convection oven at 50° C. for 2 hours, and subsequently measuring the weight loss, due to water evaporation.

The granules formed by the compaction step are subsequently contacted with specific amounts of water. This process steps is such that the resulting beads have an increased water level, being from 5.5.% to 15% by weight of the beads, more preferably 6% to 10% by weight, preferably 6% to 8% by weight.

The addition of the water does not substantially change the size of the granules and thus, the granules and the resulting beads are of about the same size. However, the surface structure of the beads is different to the surface structure of the granules.

The addition of the water is preferably done by spraying the water onto the granules, preferably in conventional equipment such as spray towers, marumerisers or fluid beds. Preferably, the water is sprayed onto the granules. Preferably, the spraying-on is carried out whilst the granules are in motion, for example by agitation. Suitable agitation means comprise drum mixers, KM Loedige (trade name) mixers, V blenders, spray granulators, fluidised beds, turbodisers (trade name) and Schugi (trade name) mixers.

The water contacting the granules preferably is free of any inorganic salts or acids, and preferably, the water is free of any purposely added ingredient, except for perfumes and/or brightners. It may be even more preferred that the water comprises a dye, to thus form coloured beads.

The bead preferably comprise a dye in low levels, preferably up to 2% or more preferably up to 1% or even up to 0.7% and it may be preferred that the dye is present a t a level of below 0.5% by weight of the bead The dye in the water, contacting the granules, may be any dye stuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

The resulting larger granules and the subsequently formed beads, preferably have a average length of 1 mm to 20 mm, preferably from 2 to 15 mm, more preferably 3 mm to 10 mm or even to 8 or even to 6 mm. They may be spherical beads, but preferably the beads are cylinder shaper, typically shaped by cutting large extrudates as described above, having a width which is smaller than the length given above, preferably about less than 50% or even less than 40% or even less than 25% of the length.

The beads preferably are such that 80% by weight of the particles has a particle size of more than 0.8 mm, as can be measured by use of Tyler mesh sieves; or more preferably 80% by weight of the particles has an particle size of more than 1.0 mm or even more than 2.0 mm The starting granular component can have any particle size, typically being smaller than the particle size of the resulting bead. Typically, the average particle size of the dry components is up to 800 microns, or even up to 600 microns.

The density of the bead is higher than the average of the sum of the densities of the dry granular components. Preferably, the bulk density (tapped) of the beads is more than 700 g/l, preferably more than 850 g/l or even more than 950 g/l.

The dry components preferably include a surfactant component. This may be a preformed granule comprising a surfactant, or it may be a surfactant granules, consisting substantially of said surfactant, such as anionic surfactant needles.

Preferred is that the granular component containing surfactant comprises at least 40% by weight of the component of the surfactant, more preferably at least 60% or even at least 80%. Preferred are surfactant needles or flakes as commercially available, for example from Manro.

Highly preferred is that at least one of the components comprises or consists of an anionic surfactant, preferably a sulphate or sulfonate surfactant. Highly preferred is that at least one of the components is a component comprising, or preferably consisting of an anionic alkyl sulphate surfactant.

Anionic sulfate surfactants suitable for use herein include the linear and branched primary and secondary alkyl sulfates, alkyl ethoxysulfates, fatty oleoyl glycerol sulfates.

Highly preferred are linear alkyl sulphates, dialkyl sulphates and/or ranched alkyl sulphates. Preferred are sodium salts thereof.

The alkyl sulfate surfactants are preferably selected from the linear and branched primary $C_{10}$–$C_{22}$ alkyl sulfates, more preferably the $C_{11}$–$C_{20}$ branched chain alkyl sulfates and the $C_{12}$–$C_{14}$ linear chain alkyl sulfates.

Anionic sulfonate surfactants suitable for use herein include the salts of a $C_5$–$C_{20}$, more preferably a $C_{10}$–$C_{16}$, more preferably a $C_{11}$–$C_{13}$ alkylbenzene sulfonates, alkyl ester sulfonates, $C_6$–$C_{22}$ primary or secondary alkane sulfonates, sulfonated polycarboxylic acids, and any mixtures thereof, but preferably $C_{11}$–$C_{13}$ alkylbenzene sulfonates.

Anionic sulphate surfactants suitable for use in the compositions or components of the invention include the primary and secondary alkyl sulphates, preferably $C_{12}$ to $C_{18}$ alkyl sulphates.

Highly preferred are beta-branched alkyl sulphate surfactants or mixtures of commercial available materials, having a weight average (of the surfactant or the mixture) branching degree of at least 50% or even at least 60% or even at least 80% or even at least 95%. It has been found that these branched sulphate surfactants provide a much better viscosity profile, when clays are present, particular when 5% or more clay is present.

It may be preferred that the only sulphate surfactant is such a highly branched alkyl sulphate surfactant, namely referred may be that only one type of commercially available branched alkyl sulphate surfactant is present, whereby the weight average branching degree is at least 50%, preferably at least 60% or even at least 80%, or even at least 90%. Preferred is for example Isalchem, as available form Condea.

Mid-chain branched alkyl sulphates or sulfonates are also suitable anionic surfactants for use in the beads herein. Preferred are the mid-chain branched alkyl sulphates. Preferred mid-chain branched primary alkyl sulphate surfactants are of the formula $$CH_3CH_2(CH_2)_wCH(\overset{R}{\overset{|}{C}}H)(CH_2)_xCH(\overset{R^1}{\overset{|}{C}}H)(CH_2)_yCH(\overset{R^2}{\overset{|}{C}}H)(CH_2)_zOSO_3M.$$

These surfactants have a linear primary alkyl sulphate chain backbone (i.e., the longest linear carbon chain which includes the sulphated carbon atom), which preferably comprises from 12 to 19 carbon atoms and their branched primary alkyl moieties comprise preferably a total of at least 14 and preferably no more than 20, carbon atoms. In compositions or components thereof of the invention comprising more than one of these sulphate surfactants, the average total number of carbon atoms for the branched primary alkyl moieties is preferably within the range of from greater than 14.5 to about 17.5. Thus, the surfactant system preferably comprises at least one branched primary alkyl sulphate surfactant compound having a longest linear carbon chain of not less than 12 carbon atoms or not more than 19 carbon atoms, and the total number of carbon atoms including branching must be at least 14, and further the average total number of carbon atoms for the branched primary alkyl moiety is within the range of greater than 14.5 to about 17.5.

Preferred mono-methyl branched primary alkyl sulphates are selected from the group consisting of: 3-methyl pentadecanol sulphate, 4-methyl pentadecanol sulphate, 5-methyl pentadecanol sulphate, 6-methyl pentadecanol sulphate, 7-methyl pentadecanol sulphate, 8-methyl pentadecanol sulphate, 9-methyl pentadecanol sulphate, 10-methyl pentadecanol sulphate, 11-methyl pentadecanol sulphate, 12-methyl pentadecanol sulphate, 13-methyl pentadecanol sulphate, 3-methyl hexadecanol sulphate, 4-methyl hexadecanol sulphate, 5-methyl hexadecanol sulphate, 6-methyl hexadecanol sulphate, 7-methyl hexadecanol sulphate, 8-methyl hexadecanol sulphate, 9-methyl hexadecanol sulphate, 10-methyl hexadecanol sulphate, 11-methyl hexadecanol sulphate, 12-methyl hexadecanol sulphate, 13-methyl hexadecanol sulphate, 14-methyl hexadecanol sulphate, and mixtures thereof.

Preferred di-methyl branched primary alkyl sulphates are selected from the group consisting of: 2,3-methyl tetradecanol sulphate, 2,4-methyl tetradecanol sulphate, 2,5-methyl tetradecanol sulphate, 2,6-methyl tetradecanol sulphate, 2,7-methyl tetradecanol sulphate, 2,8-methyl tetradecanol sulphate, 2,9-methyl tetradecanol sulphate, 2,10-methyl tetradecanol sulphate, 2,11-methyl tetradecanol sulphate, 2,12-methyl tetradecanol sulphate, 2,3-methyl pentadecanol sulphate, 2,4-methyl pentadecanol sulphate, 2,5-methyl pentadecanol sulphate, 2,6-methyl pentadecanol sulphate, 2,7-methyl pentadecanol sulphate, 2,8-methyl pentadecanol sulphate, 2,9-methyl pentadecanol sulphate, 2,10-methyl pentadecanol sulphate, 2,11-methyl pentadecanol sulphate, 2,12-methyl pentadecanol sulphate, 2,13-methyl pentadecanol sulphate, and mixtures thereof.

Anionic sulfonate surfactants suitable for use herein include the salts Of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from O to 10, and the ethoxyl ate distribution is such that, on a weight basis, the amount of material where x is 0 is less than 20% and M is a cation. Suitable alkyl polyethoxy polycarboxylate surfactants include those having the formula $RO—(CHR_1—CHR_2—O)—R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Preferably, the beads comprise at least 20% or more preferably at least 30% or even at least 50% of anionic surfactant. Even high active beads comprising 70% or even 80% or more anionic surfactants can suitable obtained by the process of the invention.

Suitable cationic surfactants to be used in the beads herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

The bead is preferably free of any bleach and/or enzymes.

Highly preferred is that the dry components forming the beads herein comprise one or more inorganic or organic acids or salts and/or builders. Any granular, dry granular salt or acid or builder can be used herein. Preferred at least a inorganic (bi) carbonate salts, phosphate salt, inorganic sulphate salt, amorphous or crystalline silicate, zeolite, polycarboxylic acid or salt thereof or mixtures thereof are present as or in one or more of the dry granular components. Preferably, the salts are sodium salts.

Highly preferred is that at least a zeolite, phosphate, but most preferably at least a carbonate salt is present.

Highly preferred is that the inorganic or organic acids or salts and/or builders are present at a level of 20% to 80%, or even 30% to 70% or even 40% to 60% by weight of the bead.

Preferred may be that the bead consists free moisture, of anionic surfactant and one or more of inorganic or organic acids or salts and/or builders, more preferably that the bead consist of free-moisture, a salt of carbonate and an anionic surfactant.

Compositions Comprising the Bead

The beads obtainable by the process of the invention are typically for incorporation in solid cleaning composition, preferably granular or tablet compositions for laundry or dish washing.

The cleaning compositions preferably comprise the bead at a level up to 80% up to 60% or even up to 40% by weight of the composition. More preferably, in particular when the beads are dyed beads, the level of the beads is from 0.5% to 20% or even 1% to 15% or even to 10% and most preferably 3 to 8% by weight of the compositions.

The compositions herein preferably comprise also granules. In granular compositions it may be preferred that the ratio of the mean particle size (length) of the bead to the mean particle size of the other particle is preferably from 20:1 or less, or more preferably from 10:1 or even 8:1 to 4:1.

The compositions may comprises in addition to the bead any ingredient or mixtures thereof commonly employed in cleaning compositions, as described herein after.

The precise nature of these additional components, and levels of incorporation thereof will depend on the physical form of the composition or component, and the precise nature of the washing operation for which it is to be used.

It may be preferred that the other particles are detergent base particles, comprising for example one or more of the ingredients of the beads herein, for example the surfactants, organic and/or inorganic builders as described above. Preferred are also bleach, perfumes, polymeric compounds including dispersants, soil suspension and anti-redeposition agents soil releasing agents enzymes, suds suppressers, brighteners, photobleaching agents and additional corrosion inhibitors. or mixtures thereof The compositions may comprise any cleaning ingredient. In a preferred embodiment the compositions are laundry detergents for softening through the wash comprising a softening clay, preferably the clay level being at least 4% by weight, preferably at least 7% by weight of the composition.

The other ingredients of the composition may be prepared by any conventional method for making detergent particles, including agglomeration, extrusion, crutching, dry mixing, spray-drying.

It may be preferred that the density of the composition herein is at least 300 g/liter, preferably up to 1200 g/liter, more preferably from 380 g/liter to 950 g/liter or even to 850 g/liter.

Preferred fabric softening clays are smectite clays, which can also be used to prepare the organophilic clays described hereinafter, for example as disclosed in EP-A-299575 and EP-A-313146. Specific examples of suitable smectite clays are selected from the classes of the bentonites—also known as montmorillonites, hectorites, volchonskoites, nontronites, saponites and sauconites, particularly those having an alkali or alkaline earth metal ion within the crystal lattice structure.

Hectorites or montmorillonite are the most preferred clays, preferably present at levels up to 12%, more preferably up to 10% or even up to 8% by weight.

Quite suitable are hectorites of natural origin, in the form of particles having the general formula $$[(MG_{3-x}Li_x)Si_{4-y}Me_y0_{10}(OH_{2-z}F_z)]^{-(x+y)}(x+y)M^{n+} \quad \text{III}$$

wherein $Me^{III}$ is Al, Fe, or B; or y=o; $M^{n+}$ is a monovalent (n=1) or divalent (n=2) metal ion, for example selected from Na, K, Mg, Ca, Sr. In the above formula, the value of (x+y) is the layer charge of the hectorite clay. Such hectorite clays are preferably selected on the basis of their layer charge properties, i.e. at least 50% is in the range of from 0.23 to 0.31. More suitable are hectorite clays of natural origin having a layer charge distribution such that at least 65% is in the range of from 0.23 to 0.31.

The hectorite clays suitable in the present composition should preferably be sodium clays, for better softening activity.

Sodium clays are either naturally occurring, or are naturally-occuring calcium-clays which have been treated so as to convert them to sodium-clays. If calcium-clays are used in the present compositions, a salt of sodium can be added to the compositions in order to convert the calcium clay to a sodium clay. Preferably, such a salt is sodium carbonate, typically added at levels of up to 5% of the total amount of clay.

Examples of hectorite clays suitable for the present compositions include Bentone EW as sold by Elementis.

Another preferred clay is an organophilic clay, preferably a smectite clay, whereby at least 30% or even at least 40% or preferably at least 50% or even at least 60% of the exchangeable cations is replaced by a, preferably long-chain, organic cations. Such clays are also referred to as hydrophobic clays. The cation exchange capacity of clays and the percentage of exchange of the cations with the long-chain organic cations can be measured in several ways known in the art, as for example fully set out in Grimshaw, The Chemistry and Physics of Clays, Interscience Publishers, Inc.,pp. 264–265 (1971).

These organophilic clays are formed prior to incorporation into the detergent composition. Thus for example, the cations, or part thereof, of the normal smectite clays are replaced by the long-chain organic cations to form the organophilic smectite clays herein, prior to further processing of the material to form the detergents of the invention.

The organophilic clay is preferably in the form of a platelet or lath-shaped particle. Preferably the ratio of the width to the length of such a platelet is at least 1:2, preferably at least 1:4 or even at least 1:6 or even at least 1:8.

When used herein, a long-chain organic cation can be any compound which comprises at least one chain having at least 6 carbon atoms, but typically at least 10 carbon atoms, preferably at least 12 carbon atoms, or in certain embodiments of the invention, at least 16 or even at least 18 carbon atoms. Preferred long-chain organic cations are described hereinafter.

Preferred organophilic clays herein clay are smectite clays, preferably hectorite clays and/or montmorillonite clays containing one or more organic cations of formulae:

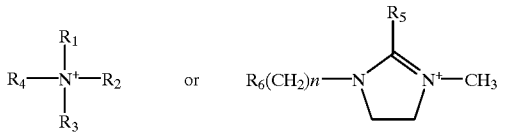

where $R_1$ represents an organic radical selected from $R_7$, $R_7$—CO—O—$(CH_2)_n$, or $R_7$—CO—$NR_8$— in which $R_7$ is an alkyl, alkenyl or alkylaryl group with 12–22 carbon atoms, whereby $R_8$ is hydrogen, $C_1$–$C_4$ alkyl, alkenyl or hydroxyalkyl, preferably —$CH_3$ or —$C_2H_5$ or —H; n is an integer, preferably equal to 2 or 3; $R_2$ represents an organic radical selected from $R_1$ or $C_1$–$C_4$ alkyl, alkenyl or hydroxyalkyl, preferably —$CH_3$ or —$CH_2CH_2OH$; $R_3$ and $R_4$ are organic radicals selected from $C_1$–$C_4$ alkyl-aryl, $C_1$–$C_4$ alkyl, alkenyl or hydroxyalkyl, preferably —$CH_3$, —$CH_2CH_2OH$, or benzyl group; $R_5$ is an alkyl or alkenyl group with 12–22 carbon atoms; $R_6$ is preferably —OH, —NHCO—$R_7$, or —OCO—$R_7$.

Highly preferred cations are quaternary ammonium cations having two $C_{16}$–$C_{28}$ or even $C_{16}$–$C_{24}$ alkyl chains. Highly preferred are one or more organic cations which have one or preferably two alkyl groups derived from natural fatty alcohols, the cations preferably being selected from dicocoyl methyl benzyl ammonium, dicocoyl ethyl benzyl ammonium, dicocoyl dimethyl ammonium, dicocoyl diethyl ammonium; more preferably ditallow diethyl ammonium, ditallow ethyl benzyl ammonium; more preferably ditallow dimethyl ammonium and/or ditallow methyl benzyl ammonium.

It may be highly preferred that mixtures of organic cations are present.

Highly preferred are organophilic clays as available from Rheox/Elementis, such as Bentone SD-1 and Bentone SD-3, which are registered trademarks of Rheox/Elementis.

An preferred additional components of the compositions is a perhydrate bleach, such as metal perborates, metal percarbonates, particularly the sodium salts. Perborate can be mono or tetra hydrated. Sodium percarbonate has the formula corresponding to $2Na_2CO_3 0.3H_2O_2$, and is available commercially as a crystalline solid.

Potassium peroxymonopersulfate, sodium per is another optional inorganic perhydrate salt of use in the detergent compositions herein.

A preferred feature of the composition is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide.

Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

As for the beads, the compositions herein may preferably contain a water-soluble builder compound, typically present in detergent compositions at a level of from 1% to 80% by weight, preferably from 10% to 60% by weight, most preferably from 15% to 40% by weight of the composition, thus possibly in addition to these builders in the beads herein.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing. The carboxylate or polycarboxylate builder can be momomeric or oligomeric in type although monomeric polycarboxylates are generally preferred for reasons of cost and performance. Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No.

1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

As for the beads, the compositions herein may contain a partially soluble or insoluble builder compound, typically present in detergent compositions at a level of from 0.5% to 60% by weight, preferably from 5% to 50% by weight, most preferably from 8% to 40% weight of the composition, thus possibly in addition to these ingredients present in the beads.

Examples of largely water insoluble builders include the sodium aluminosilicates or zeolites. The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}].xH_2O$$

wherein x is from 20 to 30, especially 27. Zeolite X has the formula $Na_{86}$ $[(AlO_2)_{86}(SiO_2)_{106}]$. 276 $H_2O$.

The compositions preferably contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Another preferred ingredient useful in the compositions herein is one or more enzymes.

Preferred enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermomyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Asperaillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic polymeric compounds are preferred additional components of the compositions herein. By organic polymeric compound it is meant herein essentially any polymeric organic compound commonly used as dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%, most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

Other organic polymeric compounds suitable for incorporation in the detergent compositions herein include cellulose derivatives such as methylcellulose, carboxymethylcellulose, hydroxypropylmethylcellulose and hydroxyethylcellulose.

The detergent compositions herein, when formulated for use in machine washing compositions, may comprise a suds suppressing system present at a level of from 0.01% to 15%, preferably from 0.02% to 10%, most preferably from 0.05% to 3% by weight of the composition.

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

The beads, but also the compositions herein also optionally contain from about 0.005% to 5% by weight of certain types of hydrophilic optical brighteners.

Hydrophilic optical brighteners useful herein include those having the structural formula:

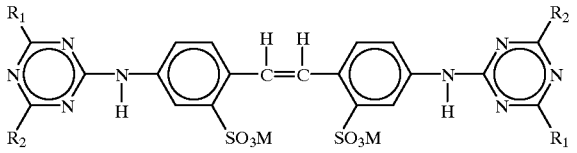

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4', -bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

EXAMPLE I

The following is a preferred process for making the beads herein:

2.5 kg of sodium carbonate particles, having 75% of particles having a particle size of from 200 microns to 450 microns and 1.0 kg of dialkylsulphate needles as available from Manro are extruded and cut into large granule having an average length of around 3.5 to 4.5 mm and an average width of around 0.25 to 0.75 mm.

The thus obtained granules are sprayed with water or a Monastral blue B solution and the resulting beads had a free-moisture content of 6.5%.

EXAMPLE II

The following is a preferred process for making the beads herein:

anionic surfactant, phosphate or zeolite and carbonate are mixed and extruded to granules which comprises 30% anionic surfactants, 35% phosphate or zeolite A, 33% carbonate and 2% free moisture. The thus obtained granules are sprayed with a water or with Pigmasol Green solution and the resulting beads had a free-moisture content of 7.5%.

Abbreviations Used in Examples

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| Soap | Sodium linear alkyl carboxylate derived from an 80/20 mixture of tallow and coconut fatty acids |
| STS | Sodium toluene sulphonate |
| TPKFA | $C_{16}$–$C_{18}$ topped whole cut fatty acids |
| STPP | Anhydrous sodium tripolyphosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula $\delta$-$Na_2Si_2O_5$ |
| Citric acid | Anhydrous citric acid |
| Carbonate | Anydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000 |
| CMC | Sodium carboxymethyl cellulose |
| Protease | Proteolytic enzyme, having 3.3% by weight of active enzyme, sold by NOVO Industries A/S under the tradename Savinase |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Lipase | Lipolytic enzyme, having 2.0% by weight of active enzyme, sold by NOVO Industries A/S under the tradename Lipolase |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| NOBS | Nonanoyloxybenzene sulfonate in the form of the sodium salt |
| NACA-OBS | (6-nonamidocaproyl) oxybenzene sulfonate |
| TAED | Tetraacetylethylenediamine |
| DTPA | Diethylene triamine pentaacetic acid |

-continued

| | |
|---|---|
| DTPMP | Diethylene triamine penta (methylene phosphonate), marketed by Monsanto under the Tradename Dequest 2060 |
| EDDS | Ethylenediamine-N,N'-disuccinic acid, (S,S) isomerin the in the form of its sodium salt. |
| Photoactivated | Sulfonated zinc phthlocyanine encapsulated in bleach (1) dextrin soluble polymer |
| Brightener 1 | Disodium 4,4'-bis(2-sulphostyryl)biphenyl |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis($(C_2H_5O)(C_2H_4O)_n$)—($CH_3$)—$N^+$—$C_6H_{12}$—$N^+$—($CH_3$) bis(($C_2H_5O$)—($C_2H_4O$))$_n$, wherein n = from 20 to 30 |
| SRP | soil release polymer |
| Silicone antifoam | Polydimethylsiloxane foam controller with siloxane-oxyalkylene copolymer as dispersing agent with a ratio of said foam controller to said dispersing agent of 10:1 to 100:1 |
| Wax | Paraffin wax |
| Bead I | as described in the example I above |
| Bead II | as described in the example II above |
| Clay | hectorite clay |

In the following examples all levels are quoted as % by weight of the composition:

EXAMPLE 1

The following detergent formulations are in accord with the invention.

| | A | B | C | D |
|---|---|---|---|---|
| Blown powder | | | | |
| LAS | 6.0 | 5.0 | 11.0 | 6.0 |
| TAS | 2.0 | — | — | 2.0 |
| Zeolite A | 24.0 | — | — | 20.0 |
| STPP | — | 27.0 | 24.0 | — |
| Sulfate | 4.0 | 6.0 | 13.0 | — |
| MA/AA | 1.0 | 4.0 | 6.0 | 2.0 |
| Silicate | 1.0 | 7.0 | 3.0 | 3.0 |
| CMC | 1.0 | 1.0 | 0.5 | 0.6 |
| Brightener 1 | 0.2 | 0.2 | 0.2 | 0.2 |
| Silicone antifoam | 1.0 | 1.0 | 1.0 | 0.3 |
| DTPMP | 0.4 | 0.4 | 0.2 | 0.4 |
| Spray on | | | | |
| Brightener | 0.02 | — | — | 0.02 |
| C45E7 | — | — | — | 5.0 |
| C45E2 | 2.5 | 2.5 | 2.0 | — |
| C45E3 | 2.6 | 2.5 | 2.0 | — |
| Perfume | 0.5 | 0.3 | 0.5 | 0.2 |
| Silicone antifoam | 0.3 | 0.3 | 0.3 | — |
| Dry additives | | | | |
| Clay | 7.0 | 12.0 | — | — |
| Bead 1 or 2 | 4.0 | 4.0 | 3.0 | 5.0 |
| Sulfate | 2.0 | 3.0 | 5.0 | 10.0 |
| Carbonate | 6.0 | 13.0 | 15.0 | 14.0 |
| Citric acid | 2.5 | 5.0 | — | 2.0 |
| SKS-6 | 10.0 | — | — | — |
| Percarbonate | 4.0 | — | 15.0 | 18.0 |
| TAED | 0.75 | 0.5 | 0.2 | 0.5 |

-continued

| | A | B | C | D |
|---|---|---|---|---|
| Protease | 1.0 | 1.0 | 1.0 | 1.0 |
| Amylase | 0.2 | 0.2 | 0.2 | 0.4 |
| Misc/minor to 100% | | | | |

EXAMPLE 2

The following granular detergent formulations are in accord with the invention.

| | E | F | G | H |
|---|---|---|---|---|
| Base granule | | | | |
| STPP | — | 22.0 | — | 15.0 |
| Zeolite A | 30.0 | — | 24.0 | 5.0 |
| Sulfate | 5.5 | 5.0 | 7.0 | 7.0 |
| MA/AA | 3.0 | — | — | — |
| LAS | 14.0 | 10.0 | 9.0 | 20.0 |
| C45AS | 8.0 | 7.0 | 9.0 | 7.0 |
| C45AE11S | — | 1.0 | — | 1.0 |
| Silicate | — | 1.0 | 0.5 | 10.0 |
| Soap | — | 2.0 | — | — |
| Brightener 1 | 0.2 | 0.2 | 0.2 | 0.2 |
| Carbonate | 6.0 | 9.0 | 8.0 | 10.0 |
| PEG4000 | — | 1.0 | 1.5 | — |
| DTPA | — | 0.4 | — | — |
| Spray on | | | | |
| C25E9 | — | — | — | 5.0 |
| C45E7 | 1.0 | 1.0 | — | — |
| C23E9 | — | 1.0 | 2.5 | — |
| Perfume | 0.2 | 0.3 | 0.3 | — |
| Dry additives | | | | |
| Carbonate | 5.0 | 10.0 | 13.0 | 8.0 |
| PVPVI/PVNO | 0.5 | — | 0.3 | — |
| Protease | 1.0 | 1.0 | 1.0 | 0.5 |
| Lipase | 0.4 | — | — | 0.4 |
| Amylase | 0.1 | — | — | 0.1 |
| Cellulase | 0.1 | 0.2 | 0.2 | 0.1 |
| DTPA | 0.5 | 0.3 | 0.5 | 1.0 |
| LOBS | — | 0.8 | — | 0.3 |
| PB1 | 5 | 3.0 | 10 | 4.0 |
| DOBA | 1.0 | — | 0.4 | — |
| TAED | 0.5 | 0.3 | 0.5 | 0.6 |
| Sulfate | 4.0 | 5.0 | — | 5.0 |
| Clay | — | 8.0 | 12.0 | 4.0 |
| Sud supressor | 1.0 | 0.5 | 2.0 | 0.5 |
| Bead 1 or 2 | 4.8 | 2.8 | 3.7 | 7.2 |
| Misc/minor to 100% | | | | |

| | I | J | K | L | M | N | O |
|---|---|---|---|---|---|---|---|
| Sodium $C_{11}$–$C_{13}$ alkylbenzenesulfonate | 12.0 | 16.0 | 23.0 | 19 | 12.0 | 20.0 | 16.0 |
| Sodium $C_{14}$–$C_{15}$ alcohol sulfate | | 4.5 | — | | — | — | 4.0 |
| $C_{14}$–$C_{15}$ alcohol ethoxylate (0.5) sulfate | | | — | — | 3.0 | — | — |
| $C_{14}$–$C_{15}$ alcohol ethoxylate (3) sulfate | — | — | 2.0 | — | — | 1.0 | 1.0 |
| Sodium $C_{14}$–$C_{15}$ alcohol ethoxylate (3.0) | 2.0 | 2.0 | — | 1.3 | — | — | 0.6 |
| $C_9$–$C_{14}$ alkyldimethyl hydroxy ethyl quaternary ammonium salt | | | — | — | 1.0 | 0.5 | 2.0 |

-continued

| | I | J | K | L | M | N | O |
|---|---|---|---|---|---|---|---|
| Tallow fatty acid | | | — | — | — | — | 1.0 |
| Tallow alcohol ethoxylate (50) | — | 1.0 | — | — | — | — | — |
| Sodium tripoly-phosphate or zeolite | 23.0 | 25.0 | 24.0 | 22.0 | 20.0 | 15.0 | 20.0 |
| Sodium carbonate | 15.0 | 12.0 | 15.0 | 10.0 | 13.0 | 11.0 | 10.0 |
| Sodium Polyacrylate (45%) | 0.5 | 0.5 | 0.5 | 0.5 | — | — | — |
| Sodium polyacrylate/ maleate polymer | — | — | 1.0 | 1.0 | 1.0 | 2.0 | 0.5 |
| Sodium perborate/ percarbonate | 18.0 | 15.0 | 10.0 | 8.0 | — | — | 5.0 |
| Poly(ethyleneglycol), MW ~4000 (50%) | 1.5 | 1.5 | 1.0 | 1.0 | — | — | 0.5 |
| Sodium carboxy methyl cellulose | 1.0 | 1.0 | 1.0 | — | 0.5 | 0.5 | 0.5 |
| Citric acid | 5.0 | 10.0 | 3.0 | 6.0 | — | 4.0 | 6.0 |
| TAED | 1.5 | 1.0 | 2.5 | 3.0 | 0.3 | 0.2 | 0.5 |
| Magnesium sulphate | — | — | — | — | 1.0 | 0.5 | 1.5 |
| Chelant | 0.5 | 0.8 | 1.0 | — | 0.8 | 0.6 | 1.0 |
| Enzymes, including amylase, amylase II, cellulase, protease and lipase | 3.0 | 2.0 | 1.0 | — | 2.0 | 1.5 | 2.0 |
| Bead I or II | 2.5 | 4.1 | 4.2 | 4.0 | 5.6 | 8.0 | 5.2 |
| minors, e.g. perfume, brightener, photo-bleach, | 1.0 | 1.0 | 1.0 | 1.0 | 0.5 | 1.5 | 1.0 |

What is claimed is:

1. A process for making beads for cleaning compositions comprising the steps of:

a) compacting an anionic surfactant and a dry granular component selected from the group consisting of zeolites, phosphate, sodium carbonate, and mixtures thereof, said granular component containing less than 4.5% by weight of free-moisture, and optionally a binder component, to form granules containing less than 4.5% by weight of free moisture said granules being free of bleach or enzymes; and b) contacting said granules with amount of water, said water being free of inorganic salts and acids, sufficient to obtain beads with a free-moisture level of from 5.5% to 15% by weight of the beads.

2. A process according to claim 1 whereby step b) is done by spraying the water onto the granules.

3. A process according to claim 1 whereby step a) is done by extrusion.

4. Process according to claim 1 whereby the free moisture level of the beads is from 6% to 10% by weight.

5. A process according to claim 1 whereby said dry granular component comprises less than 3.5% by weight of free moisture.

6. Process according to claim 1 whereby the bead comprises at least 30% by weight of a granular anionic surfactant, selected from the group consisting of alkyl sulphate surfactants, alkoxylated alkyl sulphate surfactants, alkyl sulphonate surfactants, alkylaryl sulphonate surfactants and mixtures thereof.

7. Process according to claim 6 whereby the surfactant is a linear or branched, secondary or primary, mono or di $C_{11}$–$C_{24}$ alkyl sulphate salt.

8. Process according to claim 1 whereby the bead is a cylinder-shaped particle, having an average length of 2 to 20 mm.

9. Process according to claim 1 whereby the water contacting the granule comprises a dye and the resulting bead is colored.

* * * * *